US006128777A

United States Patent [19]

Foreman

[11] Patent Number: 6,128,777

[45] Date of Patent: Oct. 10, 2000

[54] CUSTOM-FITTED BATTER'S FOREARM PROTECTOR

[75] Inventor: Louis J. Foreman, Huntersville, N.C.

[73] Assignee: Parker Athletic Products, LLC, Charlotte, N.C.

[21] Appl. No.: 09/364,213

[22] Filed: Jul. 29, 1999

[51] Int. Cl.[7] ..... A61F 5/00

[52] U.S. Cl. ..... 2/16; 128/878; 128/881; 602/6; 602/8

[58] Field of Search ..... 2/16, 22, 455, 2/267, 24; 128/878, 881, 882, 846; 602/5, 6, 7, 8, 41, 60, 65

[56] References Cited

U.S. PATENT DOCUMENTS

| | | | |
|---|---|---|---|
| 2,940,884 | 6/1960 | White . | |
| 3,557,156 | 1/1971 | Enneper et al. . | |
| 3,900,024 | 8/1975 | Lauber et al. . | |
| 3,923,049 | 12/1975 | Lauber et al. . | |
| 4,235,228 | 11/1980 | Gaylord, Jr. et al. . | |
| 4,279,344 | 7/1981 | Holloway, Jr. . | |
| 4,411,262 | 10/1983 | von Bonin et al. . | |
| 4,427,002 | 1/1984 | Baron et al. . | |
| 4,433,680 | 2/1984 | Yoon . | |
| 4,442,833 | 4/1984 | Dahlen et al. . | |
| 4,502,479 | 3/1985 | Garwood et al. . | |
| 4,570,622 | 2/1986 | von Bonin et al. . | |
| 4,572,171 | 2/1986 | Wegner et al. . | |
| 4,676,861 | 6/1987 | Bishop . | |
| 4,770,299 | 9/1988 | Parker . | |
| 4,869,046 | 9/1989 | Parker . | |
| 5,003,970 | 4/1991 | Parker et al. . | |
| 5,480,376 | 1/1996 | Duback et al. | 602/8 |
| 5,544,663 | 8/1996 | Duback . | |
| 5,637,077 | 6/1997 | Parker | 602/8 |
| 5,665,056 | 9/1997 | Nakasugi et al. | 602/8 |
| 5,732,713 | 3/1998 | Duback et al. | 128/846 |
| 5,755,678 | 5/1998 | Parker et al. | 602/6 |
| 5,833,637 | 11/1998 | Pong | 602/5 |
| 5,957,871 | 9/1999 | Darcey | 602/12 |
| 5,980,474 | 11/1999 | Darcey | 602/5 |
| 6,022,331 | 2/2000 | Darcey | 602/12 |

FOREIGN PATENT DOCUMENTS

| | | |
|---|---|---|
| 630022 | 10/1961 | Canada . |
| 2 200 286 | 8/1988 | United Kingdom . |

OTHER PUBLICATIONS

C–Splint 2 Immobilizer (1982); Cutter Laboratories, Inc.

Scotchcast 2 Splinting System (Undated) (Orthopedic Products Division, Minnesota Mining & Manufacturing Company).

*Primary Examiner*—John J. Calvert
*Assistant Examiner*—Tejash Patel
*Attorney, Agent, or Firm*—Adams, Schwartz & Evans, P.A.

[57] ABSTRACT

A batter's forearm protector product, including a forearm protector for being custom-formed to the shape of a batter's forearm while flexible and upon hardening providing a rigid, supporting custom fit. The forearm protector product includes an outer container formed of moisture-impervious material. A flexible forearm protector is positioned in the container in substantially moisture-free conditions and sealed therein against entry of moisture until use. The forearm protector includes a substrate and a reactive system impregnated into or coated onto the substrate, the system remaining stable when maintained in substantially moisture-free conditions and hardening upon exposure to moisture to form a rigid, self supporting structure. A flexible protective pad is positioned on one side of the substrate to provide cushioning between the substrate and the batter when the forearm protector is being worn. An outer cover covers the substrate on the side opposite the protective pad. The substrate, protective pad and outer cover are connected together into a unitary structure for being molded while flexible to the forearm of the player. Complementary fasteners are attached to opposing side edges of the forearm protector for retaining the forearm protector in place on the batter's forearm while being worn.

10 Claims, 4 Drawing Sheets

CUSTOM-FITTED BATTER'S FOREARM PROTECTOR

TECHNICAL FIELD AND BACKGROUND OF THE INVENTION

This invention relates to a custom-fitted batter's forearm protector, and is specifically intended to protect a baseball or softball batter's forearm, including the elbow, against being directly struck by a pitched ball. This type of impact has a high probability of causing severe bruising, broken or chipped bones of the forearm, particularly the elbow.

The forearm protector according to the invention takes advantage of polymer chemistry to permit quick and easy molding of the protector to the forearm. Shock attenuation is increased since the custom fit spreads contact between the protector and the forearm over a wider surface area. Similarly, the close, custom fit achieved when the protector is properly applied to the forearm is in distinct contrast to so-called "one size fits all" protectors used by baseball and softball players.

The protector is particularly useful with young players, whose relatively low skill level makes wild pitches more frequent and more difficult to avoid.

Prior art forearm protectors include devices which typically include a soft component to place near the skin and a hard, shell-like preformed outer cover having a curved shape approximating the curved shape of the forearm. The soft component, for example, fiber padding or foam, is intended not only to provide a cushion, but also to accommodate itself to the varying configurations of differing sized and shaped forearms. For this reason, the cushioned part is substantially greater in thickness than required merely to provide the required amount of shock attenuation and protection from the rigid outer cover.

The present invention permits quick and easy application of a protector to the forearm in such a way as to achieve a true custom fit. The moisture curable resin system used results in a very rigid protector which holds the shape of the forearm to which it was molded permanently and to a very high degree. No heat is required, and a source of water is the only additional material necessary. Atmospheric moisture alone will cure the protector into its hardened position in a relatively short period of time, but in practice the resin in or on the protector will typically be activated by dipping in water and then removing the excess by rolling the protector in a towel immediately before application. This can be easily done by an equipment manager or trainer as an integral part of properly equipping a player. The custom-molded protector becomes part of the equipment, together with gloves and batting hats, which protect the batter against injury.

SUMMARY OF THE INVENTION

Therefore, it is an object of the invention to provide a custom-moldable batter's forearm protector.

It is another object of the invention to provide a protector which can be molded to the forearm of a batter for protecting the batter's forearm while permitting complete freedom of movement during batting and baserunning.

It is another object of the invention to provide a forearm protector which can be custom-fitted to a particular player.

It is another object of the invention to provide a forearm protector which protects the elbow.

It is another object of the invention to provide a forearm protector which hardens in the presence of moisture to form a very rigid but very lightweight protector.

These and other objects of the present invention are achieved in the preferred embodiments disclosed below by providing a batter's forearm protector product, including a forearm protector for being custom-formed to the shape of a batter's forearm while flexible and upon hardening providing a rigid, supporting custom fit. The forearm protector product comprises an outer container formed of moisture-impervious material. A flexible forearm protector is positioned in the container in substantially moisture-free conditions and sealed therein against entry of moisture until use. The forearm protector is shaped to provide, when in place on a batter's forearm, protection to the forearm, including the elbow. The forearm protector comprises a substrate and a reactive system impregnated into or coated onto the substrate, the system remaining stable when maintained in substantially moisture-free conditions and hardening upon exposure to moisture to form a rigid, self supporting structure. A flexible protective pad is positioned on one side of the substrate to provide cushioning between the substrate and the batter's forearm when the forearm protector is being worn. An outer cover covers the substrate on the side opposite the protective pad. The substrate, protective pad and outer cover are connected together into a unitary structure for being molded while flexible to the forearm of the batter. Complementary fasteners are attached to opposing side edges of the forearm protector for retaining the forearm protector in place on the batter's forearm while being worn.

Preferably, the complementary fasteners comprise patches of hook-and-loop material.

According to one preferred embodiment of the invention, the container is fabricated of an aluminum foil laminate having an outer tear resistant layer, a central aluminum foil layer and an inner heat sealable plastic layer.

According to another preferred embodiment of the invention, the substrate comprises a plurality of knitted or woven fabric layers and the protective pad comprises a foam material.

According to another preferred embodiment of the invention, the foam material is chosen from the group consisting of open or closed cell EVA or polyurethane.

According to yet another preferred embodiment of the invention, the elongate outer cover is formed of a synthetic, hydrophobic fabric.

According to yet another preferred embodiment of the invention, the reactive system comprises a blended polyisocyanate, polyol, catalyst and stabilizer.

According to yet another preferred embodiment of the invention, the protective padding, substrate and outer cover are sandwiched together in overlying layers and joined together around their respective peripheral edges by sewing stitches to form a unitary structure.

According to yet another preferred embodiment of the invention, the forearm protector is asymmetrically formed to include a forearm protection segment and an elbow protection segment integrally-formed with said forearm protection segment and extending outwardly therefrom for being protectively positioned over the elbow when in place on the arm of the batter.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
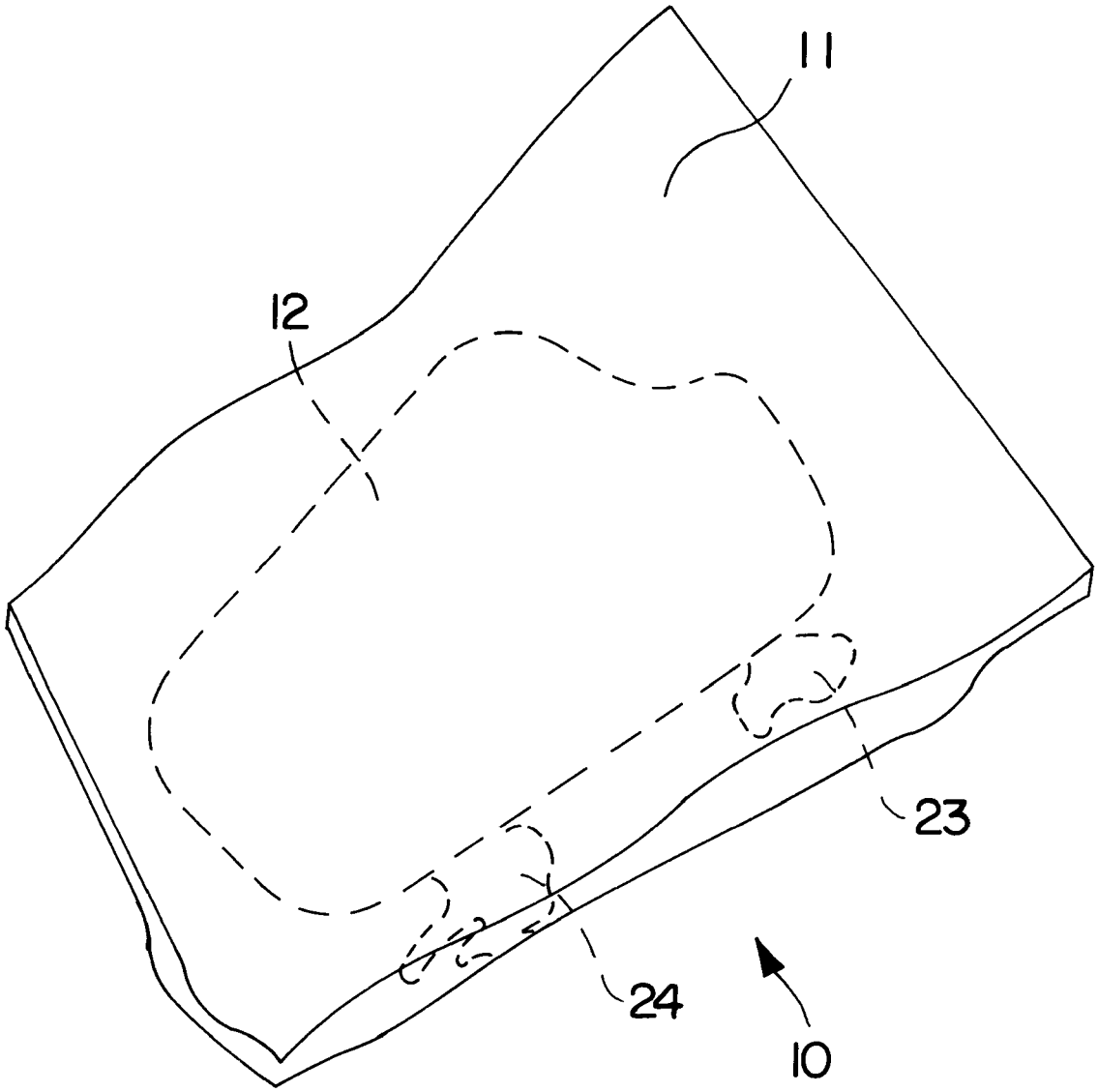
FIG. 1 is a perspective view of the protective container within which the forearm protector is contained in moisture-free conditions until use.

Referring now specifically to the drawings, a forearm protector product according to a preferred embodiment of the invention is illustrated broadly at reference numeral 10 in FIG. 1. A sealed, moisture-impervious foil and plastic laminated pouch or container 11 is fabricated of a aluminum foil laminate having an outer tear-resistant layer, a central aluminum foil layer and an inner heat-sealable plastic layer. Container 11 is opened with scissors or a knife, and a forearm protector 12 according to an embodiment of the invention is removed immediately prior to being molded to the forearm of the player.

Figure 2:
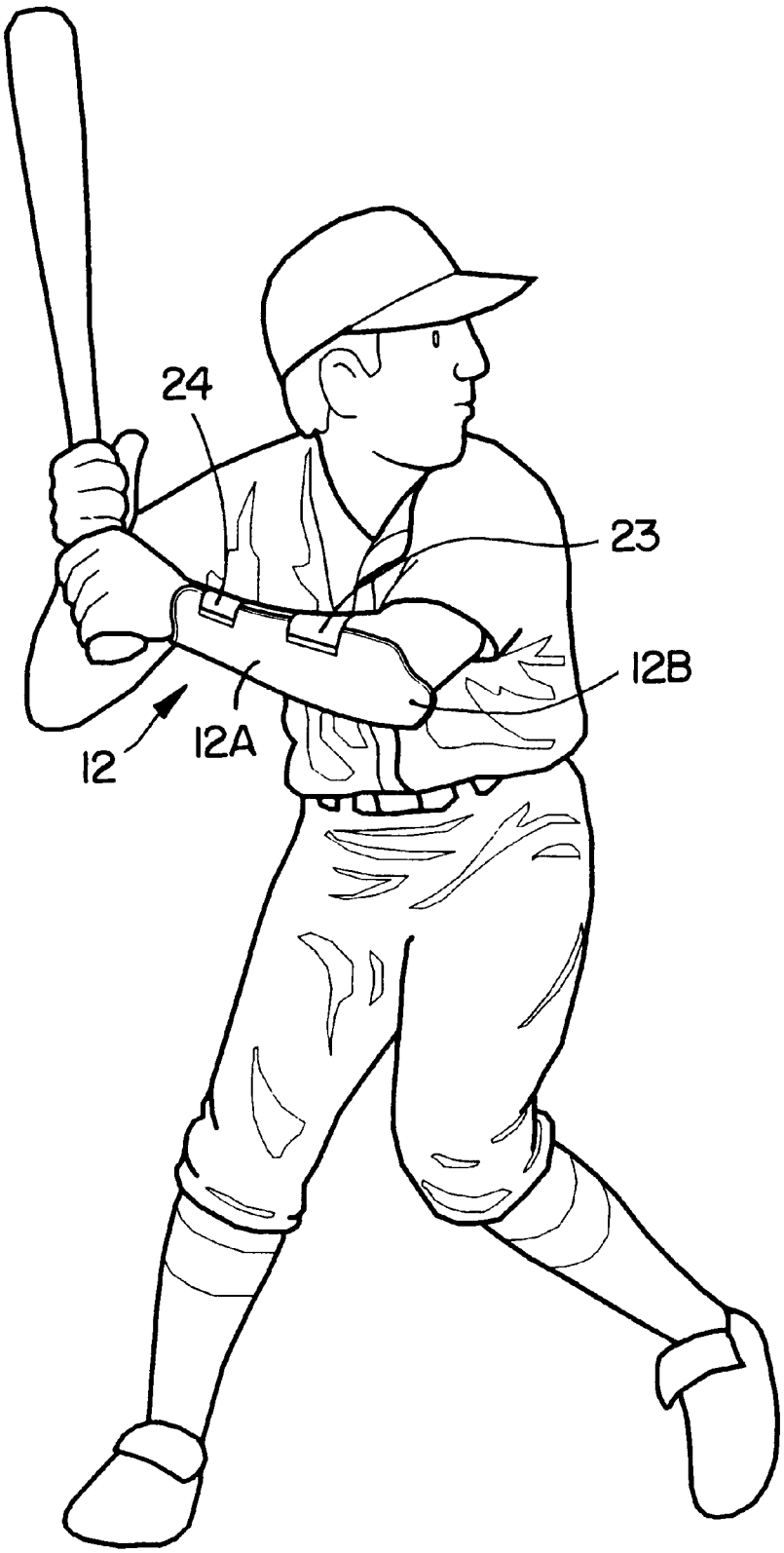
FIG. 2 illustrates a baseball or softball batter wearing a forearm protector according to an embodiment of the present invention.

The forearm protector 12 is shown in position on the forearm of a batter in FIG. 2. Note that the forearm protector 12 includes a forearm protection segment 12A which extends from the wrist to just below the elbow, and a elbow protection segment 12B which extends outwardly to fully cover the elbow in the direction of the pitcher's mound when the arm is raised into batting position, as shown in FIG. 2. As is apparent from the drawing in FIG. 2, a righthanded batter will wear the forearm protector 12 on the left forearm, since the left arm is the arm most exposed to the pitcher and therefore the arm most likely to be hit by a pitch. Conversely, a lefthanded batter will protect the right forearm in the same manner.

Figure 3:
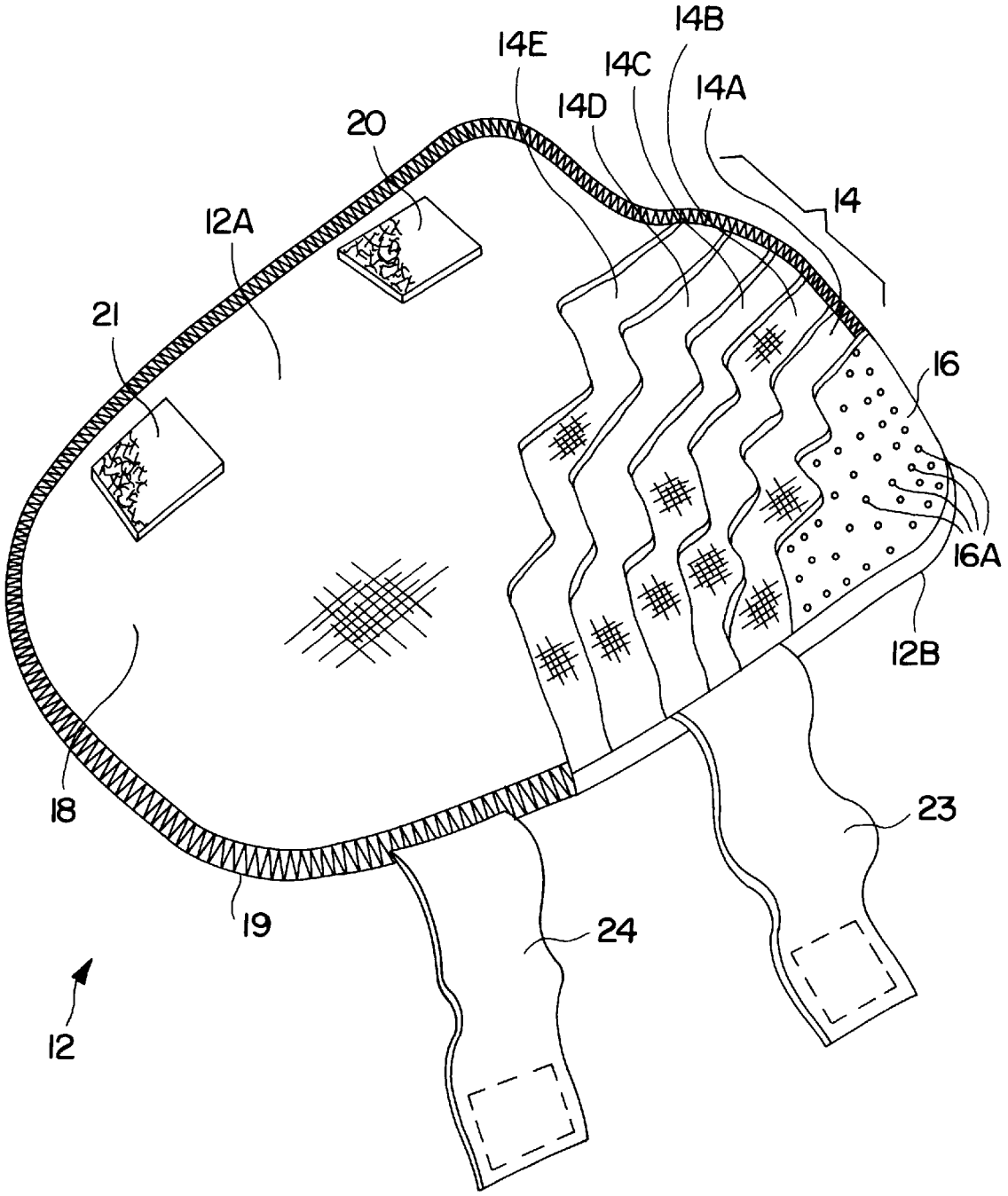
FIG. 3 is a perspective view, with parts broken away, of the outer side of the forearm protector.
Figure 4:
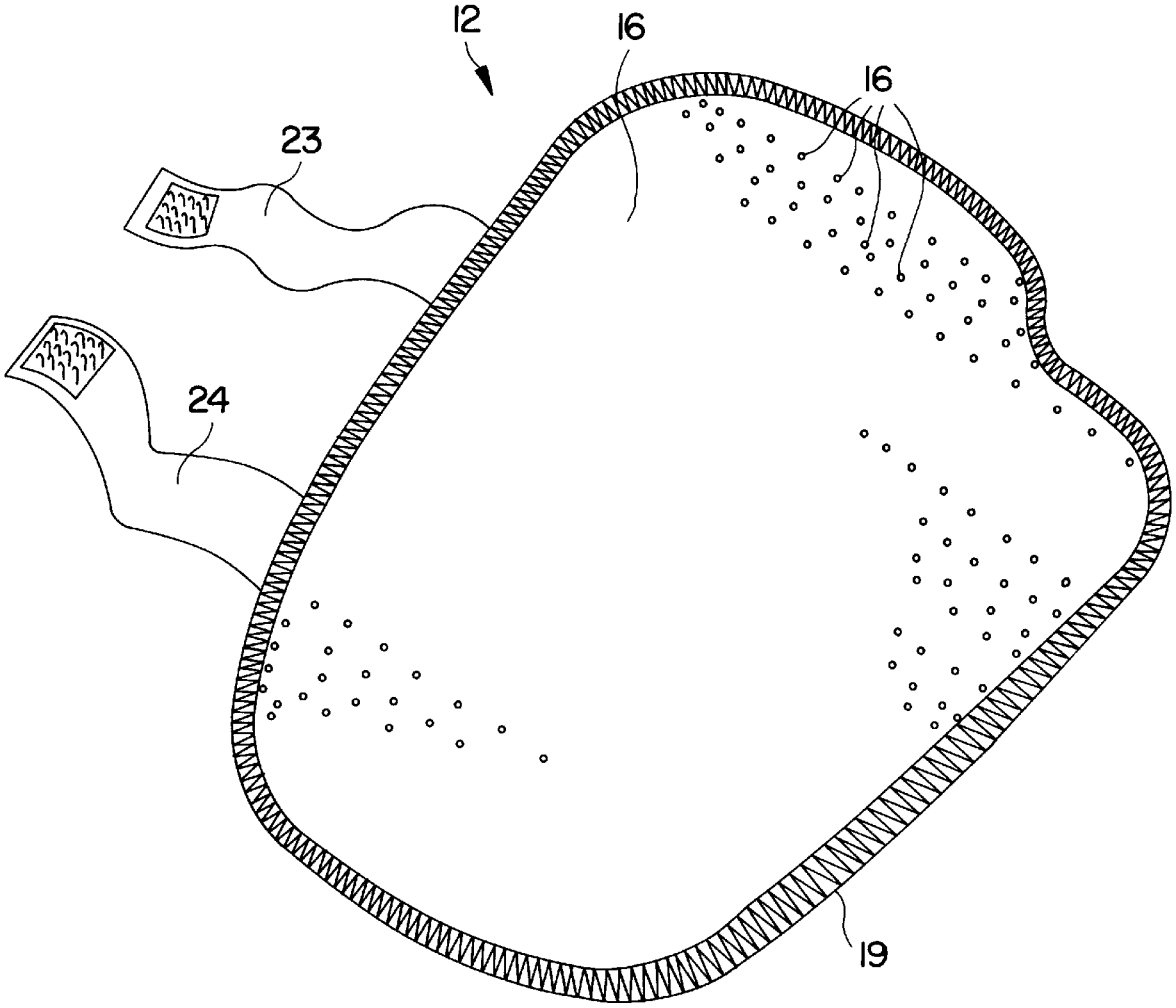
FIG. 4 is a perspective view of the inner side of the forearm protector.

Referring now to FIGS. 3 and 4, the asymmetric shape of the forearm protector 12 defined by the forearm protection segment 12A and the elbow protection segment 12B is apparent. The forearm protector 12 is molded to and extends around the generally frustoconical structure of the forearm. The forearm protector 12 includes a multilayer substrate 14 formed of, for example, five layers of woven fiberglass fabric 14A–E overlaid in registration with each other to form a laminated structure.

Other fabric material and constructions, such as knitted polypropylene, can also be used for the substrate fabric.

The fiberglass fabric layers 14A–E of the substrate 14 are impregnated or coated with a moisture-curable resin such as polyisocyanate as described in full in the U.S. Pat. No. 4,770,299. This reactive system remains stable when maintained in substantially moisture-free conditions, such as in the moisture-impervious pouch 11, but hardens upon exposure to sufficient moisture to form a rigid, self-supporting structure. A typical formulation of the reactive system is set forth in the following table:

| Typical Formulation: | | | |
|---|---|---|---|
| Isonate↓ 143L | or | | |
| Mondur↓ CD | or | polyisocyanate | 50.0% |
| Rubinate ↓ XI168 | | | |
| Pluracol↓ P1010 | | polyol | 46.6% |
| DC-200 Silicone | | defoaming agent | 0.30% |

-continued

| Typical Formulation: | | |
|---|---|---|
| Benzoyl Chloride | stabilizer | 0.10% |
| Thancat↓ DM-70 | catalyst | 3.0% |
| | | 100% |

A complete discussion of the parameters of the reactive system, the manner of production and the variables which apply are found in U.S. Pat. No. 4,411,262.

The polyisocyanate resin remains in a viscous, liquid unhardened state so long as the resin is not exposed to moisture. This permits the fiberglass layers 14A–E to remain flexible and moldable so long as the resin is not exposed to moisture, and for a relatively short period of time after exposure to moisture. The curing time can be controlled to some extent by the quantity of water to which the resin is exposed. For example, exposure to water by dipping will result in quite rapid curing, while merely allowing the resin to be exposed to air will cause long curing times proportional to the amount of moisture in the air to which it is exposed.

Resin coated or impregnated fiberglass layers 14A–E are covered with a foam protective pad 16 which may be a single thickness or a laminated structure. One preferred embodiment is a 3/16 inch, six pound EVA (ethylene vinyl acetate) pad. Another embodiment may be a 3/8 inch laminated pad of a 1/8 inch outer EVA pad and a 1/4 inch outer polyethylene/polyurethane, combination open and closed cell foam. Spaced-apart ventilation holes 16A permit rapid penetration of water to the substrate 14 during wetting and curing, and permit improved air flow and cooling while being worn by the player.

The pad 16 covers and provides cushioning between the skin and the rigid substrate 14. The pad 16 is flexible enough to bend easily with the other components of the forearm protector 12 during fitting and curing. The pad 16 underlies the entire length and width of the forearm protector 12. The pad 16 and the substrate 14 are approximately the same thickness—on the order of about 4–6 mm.

A fabric outer cover 18 such as a woven polyester fabric, covers the side of the substrate 14 opposite the side covered by the foam pad 16. The fabric outer cover 18 is sewn with, for example, an overedge or serging seam 19 directly to the edges of the foam pad 16 enclosing the substrate 16.

Patches 20, 21 of male or female hook-and-loop material are sewn or otherwise secured onto the cover 18 of the forearm protector 12 adjacent one side edge. Attachment straps 23, 24 having male or female hook-and-loop material complementary to patches 20, 21 are sewn to the forearm protector 12 adjacent the opposing side edge and are extended around the forearm and releaseably attached to the patches 20, 21, respectively, to keep the forearm protector 12 securely in position on the forearm. The attachment straps 23, 24 may also be used when initially molding the forearm protector 12 to the forearm, or the forearm protector may be overwrapped with, for example, an elastic bandage, until hardening is complete. The forearm protector 12 will harden within a matter of minutes, and will permanently retain the conformation in which it was held during curing. The fit is so close and exact that the protective pad 16 can be very thin and still offer excellent protection to the batter. This is an important consideration since the forearm protector 12 must not interfere with the batter's mobility while in the batter's box and during base running.

A custom-formable batter's forearm protector is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A batter's forearm protector product, including a forearm protector for being custom-formed to the shape of a batter's forearm while flexible and upon hardening providing a rigid, supporting custom fit, said forearm protector product comprising:

(a) an outer container formed of moisture-imnpervious material;

(b) a flexible forearm protector positioned in the container in substantially moisture-free conditions and sealed therein against entry of moisture until use, the forearm protector shaped to provide, when in place on a batter's forearm, protection to the forearm including the elbow, said forearm protector comprising:

(i) a substrate;

(ii) a reactive system impregnated into or coated onto the substrate, the system remaining stable when maintained in substantially moisture-free conditions and hardening upon exposure to moisture to form a rigid, self supporting structure;

(iii) a flexible protective pad positioned on one side of the substrate to provide cushioning between the substrate and the batter's forearm when the forearm protector is being worn;

(iv) an outer cover covering the substrate on the side opposite the protective pad; and (v) said substrate, protective pad and outer cover connected together into a unitary structure for being molded while flexible to the forearm of the batter, said unitary structure comprising an asymmetric bilobal shape including a primary elbow protection lobe for extending along the lateral aspect of the forearm from the wrist to beyond the elbow to provide protection to the forearm and elbow against impact from a baseball, and a secondary forearm protection lobe rigidly integral with said primary elbow protection lobe for extending along the outer extent of the forearm from the wrist to the upper forearm but not including the elbow to provide protection to the forearm while providing enhanced mobility to the batter's arm during batting; and (c) first and second complementary fasteners attached to opposing side edges of the forearm protector, at least one of said first and second complementary fasteners being adapted for extending circumferentially around the forearm and releasably attaching to the second complementary fastener for retaining the forearm protector in place on the batter's forearm while being worn.

2. A batter's forearm protector product according to claim 1, wherein said complementary fasteners comprise patches of hook-and-loop material.

3. A batter's forearm protector product according to claim 1, or 2, wherein the container is fabricated of an aluminum foil laminate having an outer tear resistant layer, a central aluminum foil layer and an inner heat sealable plastic layer.

4. A batter's forearm protector product according to claim 1, 2 or 3, wherein the substrate comprises a plurality of knitted or woven fabric layers.

5. A batter's forearm protector product according to claim 1, 2, or 3, wherein the protective pad comprises a foam material.

6. A batter's forearm protector product according to claim 5, wherein the foam material is chosen from the group consisting of open or closed cell EVA or polyurethane.

7. A batter's forearm protector product according to claim 1, wherein the outer cover is formed of a synthetic, hydrophobic fabric.

8. A batter's forearm protector product according to claim 1, wherein the reactive system comprises a blended polyisocyanate, polyol, catalyst and stabilizer.

9. A batter's forearm protector product according to claim 1, wherein said protective padding, substrate and outer cover are sandwiched together in overlying layers and joined together around their respective peripheral edges by sewing stitches to form a unitary structure.

10. A batter's forearm protector product according to claim 1, wherein said forearm protector is asymmetrically formed to include a forearm protection segment and an elbow protection segment integrally-formed with said forearm protection segment and extending outwardly therefrom for being protectively positioned over the elbow when in place on the arm of the batter.

* * * * *